US010472156B2

(12) United States Patent
Pahls

(10) Patent No.: US 10,472,156 B2
(45) Date of Patent: Nov. 12, 2019

(54) METHOD AND APPARATUS FOR A CONTAINER HAVING A LINER

(71) Applicant: Kenneth Robert Pahls, North Vernon, IN (US)

(72) Inventor: Kenneth Robert Pahls, North Vernon, IN (US)

( * ) Notice: Subject to any disclaimer, the term of this patent is extended or adjusted under 35 U.S.C. 154(b) by 0 days.

(21) Appl. No.: 15/606,202

(22) Filed: May 26, 2017

(65) Prior Publication Data

US 2017/0341816 A1 Nov. 30, 2017

Related U.S. Application Data

(60) Provisional application No. 62/392,307, filed on May 27, 2016.

(51) Int. Cl.
*B65D 25/16* (2006.01)
*B65D 81/24* (2006.01)
*B65D 83/00* (2006.01)

(52) U.S. Cl.
CPC ..... *B65D 81/24* (2013.01); *B65D 25/16* (2013.01); *B65D 83/0055* (2013.01)

(58) Field of Classification Search
CPC .... B65D 25/1416; B65D 77/06; B65D 25/14; B65D 25/16; B65D 83/055; B65D 5/60; B65D 83/0055
USPC ..... 229/117.27
See application file for complete search history.

(56) References Cited

U.S. PATENT DOCUMENTS 2,700,518 A * 1/1955 Earle ..... B65D 81/07 206/583
3,129,867 A * 4/1964 Schroeder ..... B65D 5/563 220/495.11
3,240,394 A * 3/1966 Modderno ..... B65D 83/62 222/95
3,306,488 A * 2/1967 Lemelson ..... B23K 11/065 220/270
3,550,803 A * 12/1970 Pierre ..... B65D 77/0493 215/12.1
3,933,263 A * 1/1976 Frew ..... A47J 41/0088 215/12.1
3,940,052 A * 2/1976 McHugh ..... B65D 25/16 220/495.11
3,955,006 A * 5/1976 Sokolsky ..... B65B 7/2857 220/256.1
4,267,928 A * 5/1981 Curry, Jr. ..... A23B 4/00 206/497
4,466,553 A * 8/1984 Zenger ..... B65D 25/18 206/524.8
4,982,872 A * 1/1991 Avery ..... B65D 25/14 220/62.13
5,169,019 A * 12/1992 Budenbender ..... B65D 77/06 220/495.08
5,211,305 A * 5/1993 Horton ..... B65D 5/606 229/117.27
5,279,442 A * 1/1994 Jentzsch ..... B21D 51/2646 220/671

(Continued)

FOREIGN PATENT DOCUMENTS

CN 204056634 U 12/2014

*Primary Examiner* — Justin M Larson
(74) *Attorney, Agent, or Firm* — Indiana University Maurer School of Law IP Legal Clinic

(57) ABSTRACT

A container for materials, such as food, having a container body and a liner filled with the material.

9 Claims, 2 Drawing Sheets

(56) References Cited

U.S. PATENT DOCUMENTS

| | | | | |
|---|---|---|---|---|
| 5,337,915 | A * | 8/1994 | Hall, Jr. | B65D 25/16 206/804 |
| 5,516,007 | A * | 5/1996 | Larson | B65D 1/0223 222/105 |
| 5,627,150 | A * | 5/1997 | Peterson | A47L 15/4436 206/515 |
| 5,789,684 | A * | 8/1998 | Masek | B01L 3/505 141/316 |
| 6,116,467 | A * | 9/2000 | Petriekis | B65D 77/06 141/114 |
| 6,119,884 | A * | 9/2000 | Lowry | B65D 83/0072 220/495.03 |
| 6,216,907 | B1 * | 4/2001 | Morneau | B65D 7/045 220/4.04 |
| 6,189,735 | B1 | 9/2001 | Phallen | |
| 6,598,764 | B1 | 7/2003 | Stern | |
| 6,675,971 | B2 * | 1/2004 | Case | B65D 3/22 206/524.8 |
| 6,739,500 | B1 * | 5/2004 | Gentile | B65D 15/06 206/524.8 |
| 7,556,167 | B2 * | 7/2009 | Giwargis | B65D 83/005 220/23.83 |
| 8,002,200 | B2 * | 8/2011 | Joseph | B05B 7/2408 239/328 |
| 9,371,180 | B2 * | 6/2016 | Corbitt | B65F 1/06 |
| 2006/0065132 | A1 * | 3/2006 | Jongen | B65D 83/0055 99/485 |
| 2010/0133281 | A1 * | 6/2010 | Wojcik | B65D 21/08 220/666 |
| 2013/0233886 | A1 | 9/2013 | Long et al. | |
| 2014/0217113 | A1 * | 8/2014 | Gallagher | B65D 25/16 221/64 |

* cited by examiner

METHOD AND APPARATUS FOR A CONTAINER HAVING A LINER

CROSS REFERENCE TO RELATED APPLICATIONS

The present application claims the benefit of U.S. Provisional Application No. 62/392,307, filed May 27, 2016, titled "Process for Inserting a Plastic Bag Inside a Container to Coat the Inside Surface Layer of that Container," to Kenneth R. Pahls, the entire disclosure of which is hereby incorporated by reference.

FIELD OF THE DISCLOSURE

Containers having liners are used to storage materials. Some containers have liners.

BACKGROUND AND SUMMARY OF THE DISCLOSURE

Containers are often used to store materials, such as food. Depending upon the substance stored in a container, it may be difficult to remove substantially all of the material from the container.

According to the present disclosure, a container and liner are provided.

BRIEF DESCRIPTION OF THE DRAWINGS

The aforementioned aspects and many of the intended features of this disclosure will grow to be appreciated at a greater level once references to the following accompanying illustrations are expounded upon.

Figure 1:
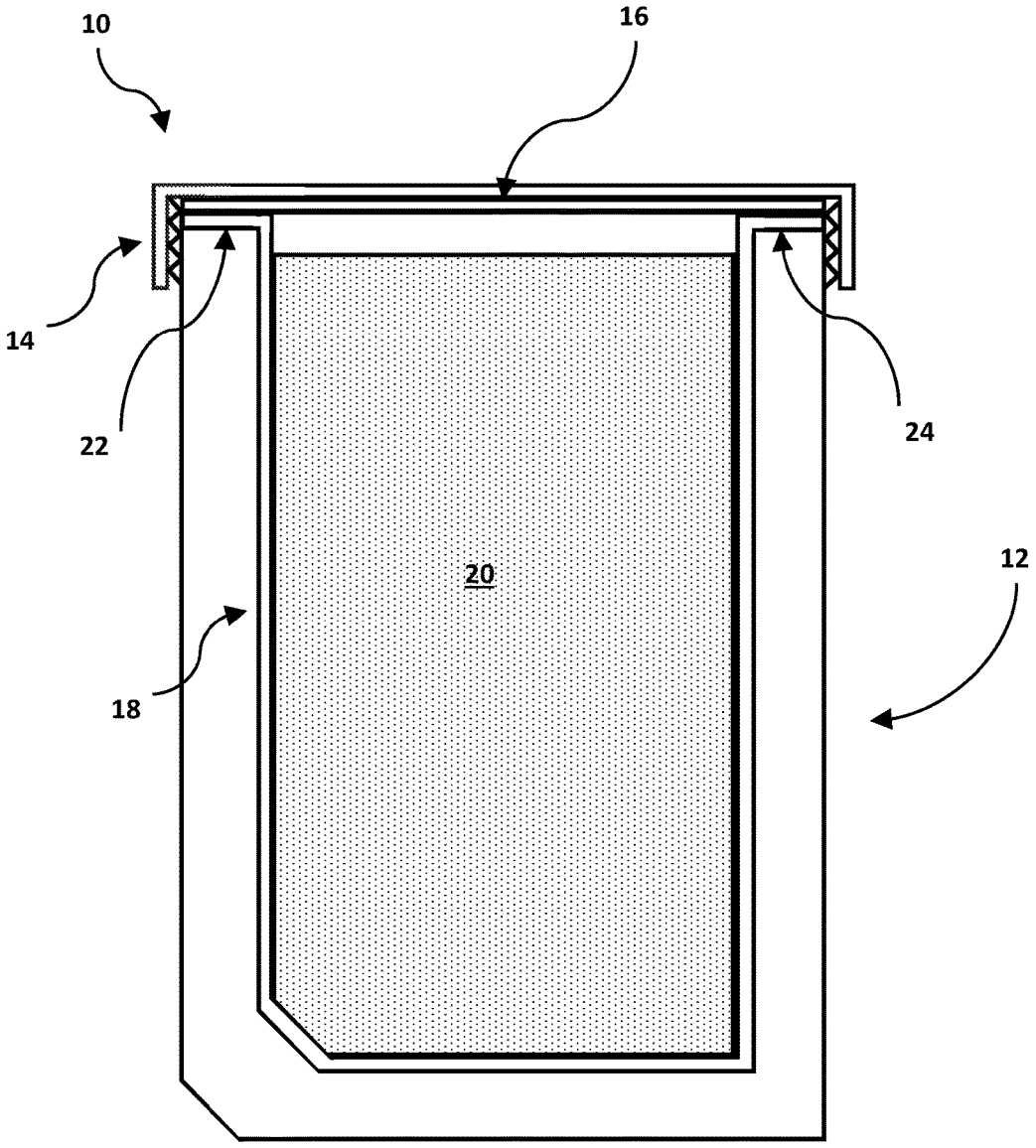
FIG. 1 is a cross sectional view of a container having a container body and a liner positioned in the container filed with a material.

Equivalent reference components point to corresponding parts throughout the several views. Unless otherwise indicated, the components shown in the drawings are proportional to each other. Wherein, the illustrations depicted are manifestations of the disclosure, and such illustrations shall in no way be interpreted as limiting the scope of the disclosure.

For the purposes of promoting an understanding of the principals of the disclosure, reference will now be made to the embodiments illustrated in the drawings, which are described below. The embodiments disclosed below are not intended to be exhaustive or limit the disclosure to the precise form disclosed in the following detailed description. Rather, the embodiments are chosen and described so that others skilled in the art may utilize their teachings. It will be understood that no limitation of the scope of the disclosure is thereby intended. The disclosure includes any alterations and further modifications in the illustrative devices and described methods and further applications of the principles of the disclosure which would normally occur to one skilled in the art to which the disclosure relates.

DETAILED DESCRIPTION OF THE DRAWINGS

According to the present disclosure, a container 10 is provided having a container body 12, a lid 14 and a safety seal 16. Container 10 is configured to store materials, such as food 20. Some foods 20 are more difficult to remove from containers, particularly food that is near the bottom of a container, particularly the bottom corners or other areas that are difficult to reach. Container 10 also includes a liner 18 positioned between container body 12 and food 20 that can be removed along with remaining food 20 to facilitate use of the remaining food 20. In addition to food, other materials may be stored in container 20, such as household products (dish soap, laundry detergent, cleaning products, etc.), beauty products (lotions, facial creams, hair gel, acne cream, etc.), coatings (paints, varnishes, oils, etc.) etc. Food 20 that may be stored in container 10 include condiments (ketchup, mustard, etc.), peanut butter, jelly and jams, mayonnaise, marinades, other thick liquid foods, etc.

Container body 12, lid 14, and liner 18 are preferably made of liquid proof materials so that food 20 stored in container 10 will not leak through container body 12 and lid 14 if they come into contact with container body 12 and lid 14. For example, container body 12 and lid 14 may be made of glass, more rigid plastic, metal, or other suitable materials. To facilitate insertion and removal (as discussed below), liner 18 is typically made of a thinner, more flexible plastic. Liner 18 may also be made of an antibacterial plastic.

Figure 2:
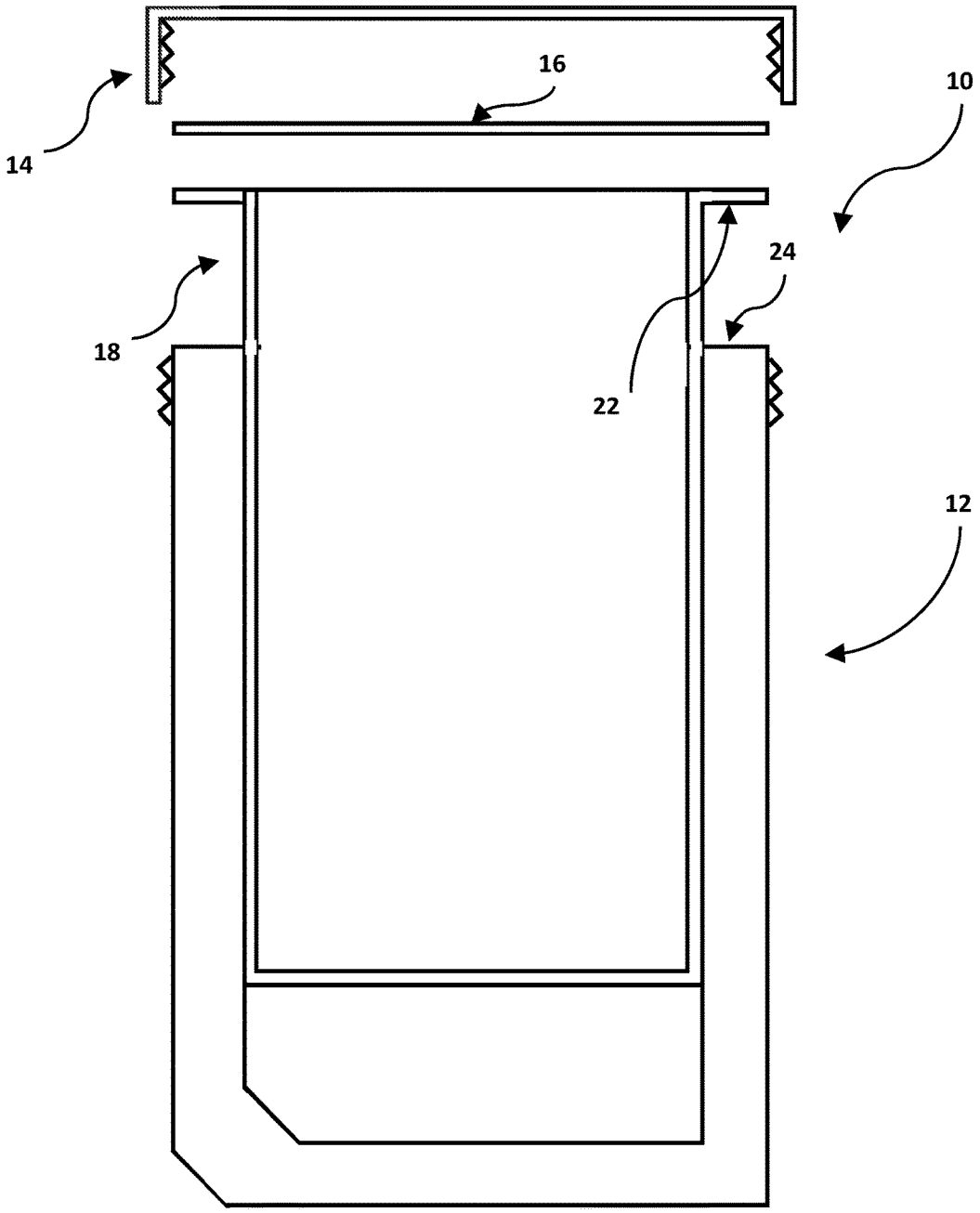
FIG. 2 is a view similar to FIG. 2 with the components before assembly and without the material.

To assembly container 10, liner 18 is positioned inside container body 12 with an upper flange 22 of liner 18 positioned over an upper lip 24 of container body 12. Next food 20, or any other material to be stored in container 10, is inserted into liner 18. During filling of liner 18, liner 18 conforms to the interior shape of container body 12. For example, as shown in FIGS. 1 and 2, container body 12 includes a rib or indentation 24. Liner 18 conforms to rib 24 during filling as shown in FIG. 1. Similarly, air that was between liner 18 and container body 12 is forced out of container body 12 between upper flange 22 of liner 18 and upper lip 24 of container body 12. Upon filing of liner 18, safety seal 16 and upper flange 22 are secure to each other and to container body 12, preferably at upper lip 24 of container body 12 using heat, an adhesive, or other method of attachment. Next, lid 14 is secured to container body 12.

To consume food 20 or use any other material stored in container 10, a user unscrews lid 14 other otherwise removes lid 14. Next, safety seal 16 is removed from container body 12, preferably leaving upper flange 22 of liner 18 attached to container body 12, to expose food 20. A user can then remove the bulk of food 20 for consumption, etc.

When it becomes difficult to remove the last portions of food 20 from container 10, a user may peal or otherwise disconnect upper flange 22 of liner 18 from container body 12. Next, the user may remove liner 18 containing the last portions of food 20 from container 10 and squeeze or otherwise remove the last portions of food 20 from liner 18. All components of container 10 may then be discarded, recycled, etc.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practices in the art to which this disclosure pertains.

The invention claimed is:

1. A method for emptying a container, the method comprising the steps of providing the container with product therein, the container including:

a container body having an upper lip, a seal attached to the container body, a screw-on lid coupled to the container body, a removable liner positioned inside the container body and attached to the seal, and the product substantially filling the liner, removing the screw-on lid from the container body, removing a bulk of the product from the removable liner while the removable liner is positioned in the container body, removing the removable liner from the container body after the step of removing the bulk of the product, and removing additional product from the removable liner while the removable liner is positioned outside of the container body.

2. The method of claim 1, further comprising a step of removing the seal after the step of removing the screw-on lid.

3. The method of claim 1, wherein the container body has a top and a bottom, the screw-on lid is coupled to the top, and the removable liner covers the bottom.

4. The method of claim 3, wherein the bottom includes a rib and the removable liner contours to the rib.

5. The method of claim 4, wherein the bottom includes a substantially square corner and the removable liner contours to the substantially square corner.

6. The method of claim 3, wherein the bottom includes a substantially square corner and the removable liner contours to the substantially square corner.

7. The method of claim 6, wherein the additional product removed from the removable liner was positioned adjacent to the substantially square corner prior to the removable liner being removed from the container body.

8. The method of claim 7, wherein the additional product removed from the removable liner was positioned between the substantially square corner and the bulk of the product prior to removing the bulk of the product from the removable liner.

9. The method of claim 1, further comprising a step of disconnecting the removable liner from the container body prior to the step of removing the additional product from the removable liner.

* * * * *